US005518431A

United States Patent [19]

Staley

[11] Patent Number: 5,518,431

[45] Date of Patent: May 21, 1996

[54] FLOATING RECREATIONAL SEATING DEVICE

[76] Inventor: James J. Staley, 5203 Green Meadow Rd., Roanoke, Va. 24018

[21] Appl. No.: 393,192

[22] Filed: Feb. 23, 1995

[51] Int. Cl.[6] ..... B63C 9/08; E04H 4/14

[52] U.S. Cl. ..... 441/130; 4/496; 114/345; 441/40

[58] Field of Search ..... 4/494, 496, 513; 441/40, 129–132; 114/345

[56] References Cited

U.S. PATENT DOCUMENTS

| | | | |
|---|---|---|---|
| 4,466,145 | 8/1984 | Jones et al. | 441/40 X |
| 4,696,251 | 9/1987 | Spieldiener et al. | 114/345 X |
| 5,203,860 | 4/1993 | Bollant | 441/40 |
| 5,233,705 | 8/1993 | Coleman et al. | 4/496 |
| 5,299,721 | 4/1994 | Cummings | 441/40 X |
| 5,394,822 | 3/1995 | Worland | 114/345 |

*Primary Examiner*—Charles E. Phillips

[57] ABSTRACT

A floating recreational seating device comprised of an inflatable tube portion formed by four semi-circle portions. An air intake valve extends inwardly within the inflatable tube portion. The air intake valve couples with a pipe that extends inwardly of the inflatable tube portion. The inflatable tube portion has a plurality styrofoam blocks disposed intermittently therein. Each of the styrofoam blocks has a pipe extending therethrough. The pipe allows air to flow through the inflatable tube portion. The inflatable tube portion serves to fill with air to float in a body of water. Four seat portions are secured to the four semi-circle portions of the inflatable tube portion. The four seat portions extend downwardly of the inflatable tube portion. The four seat portions are adapted for a user to sit in while the inflatable portion is within a body of water. A square support portion secures to the four securement rings of the inflatable tube portion. The square support portion is adapted to hold an ice chest or cooler thereon when the inflatable tube portion is within a body of water.

7 Claims, 4 Drawing Sheets

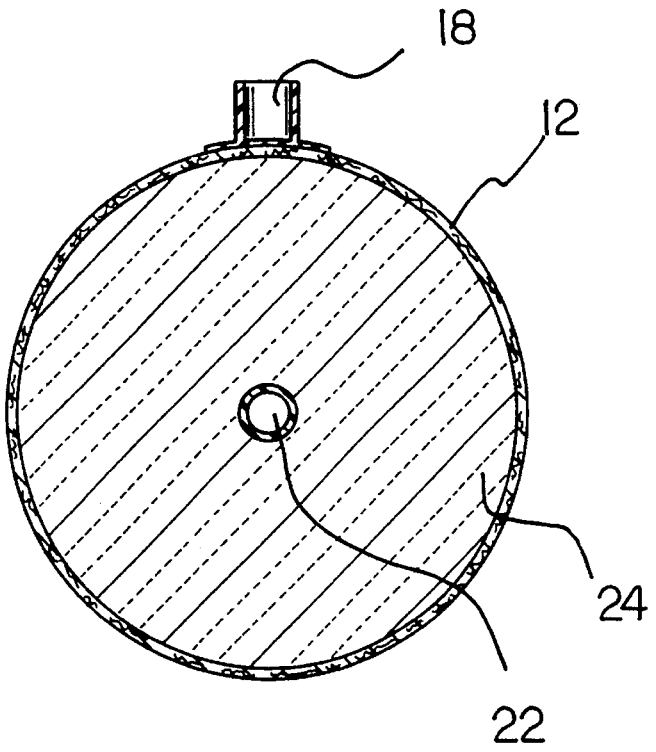
FIG. 3
FIG. 4
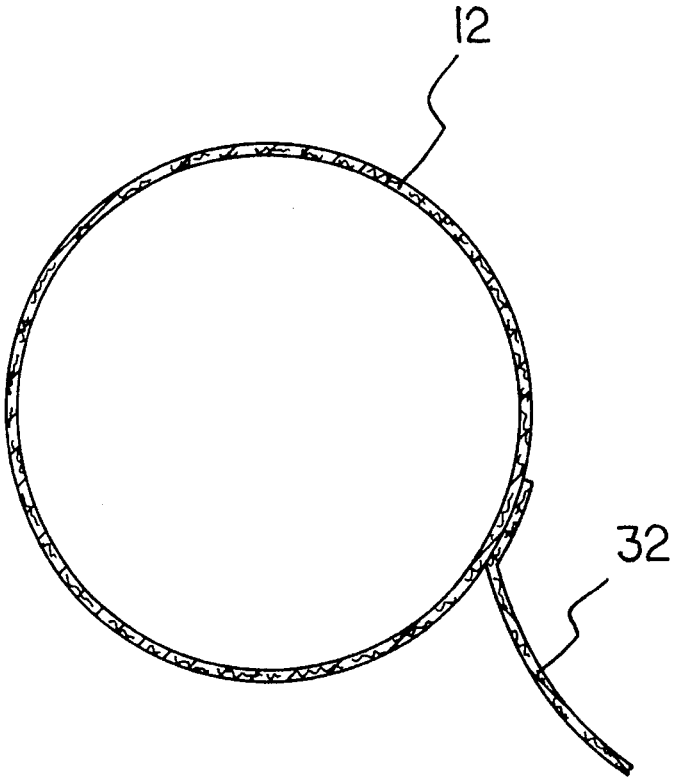

FIG. 5
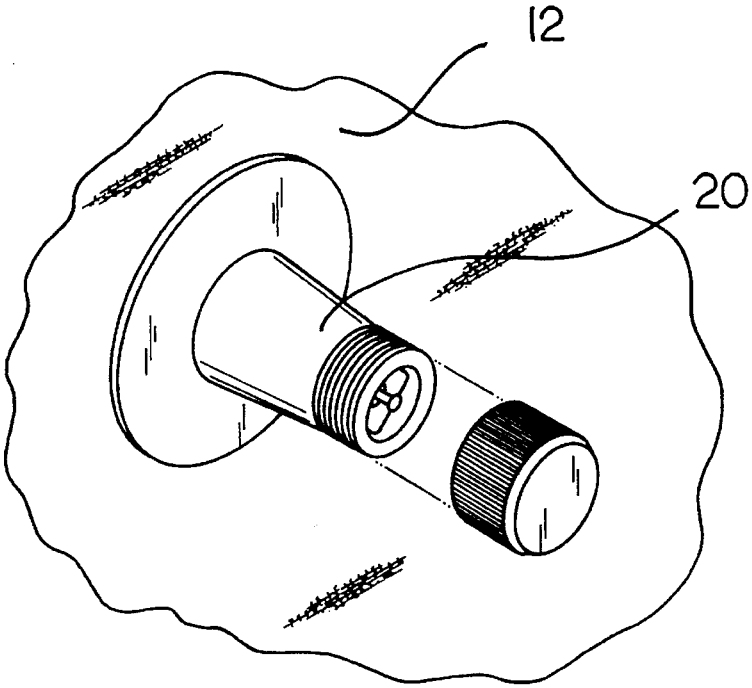
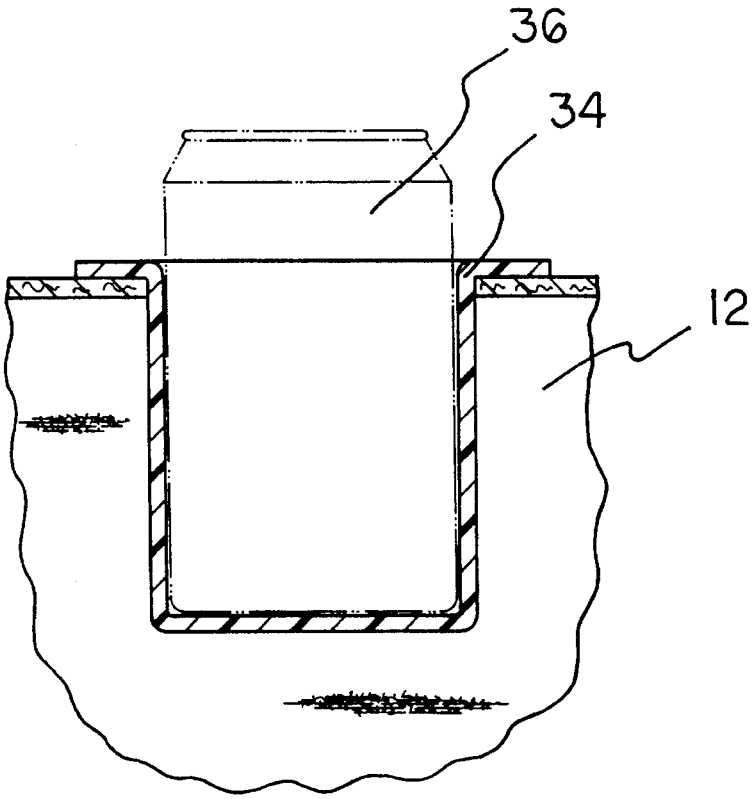
FIG. 6

FIG. 7
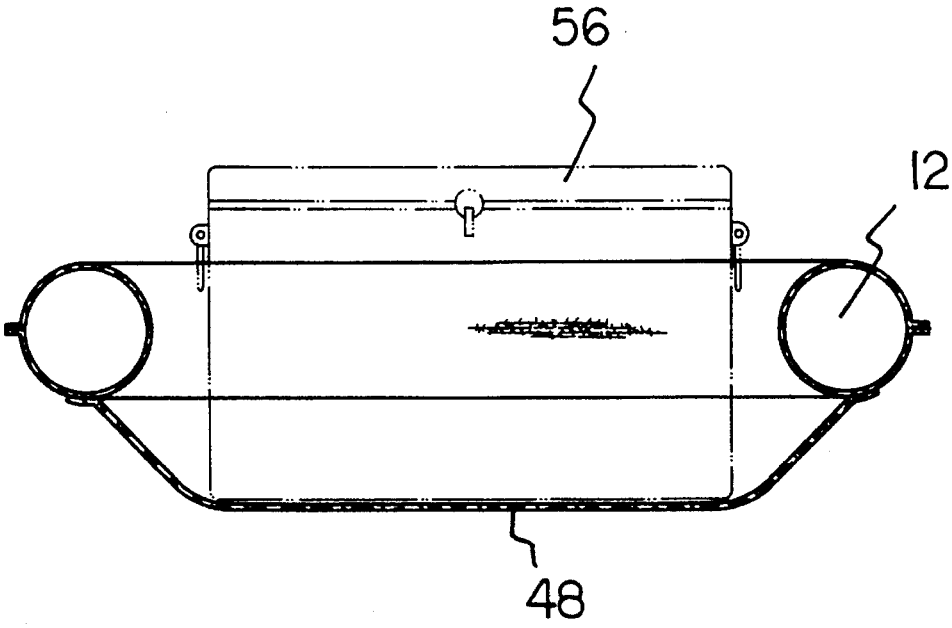
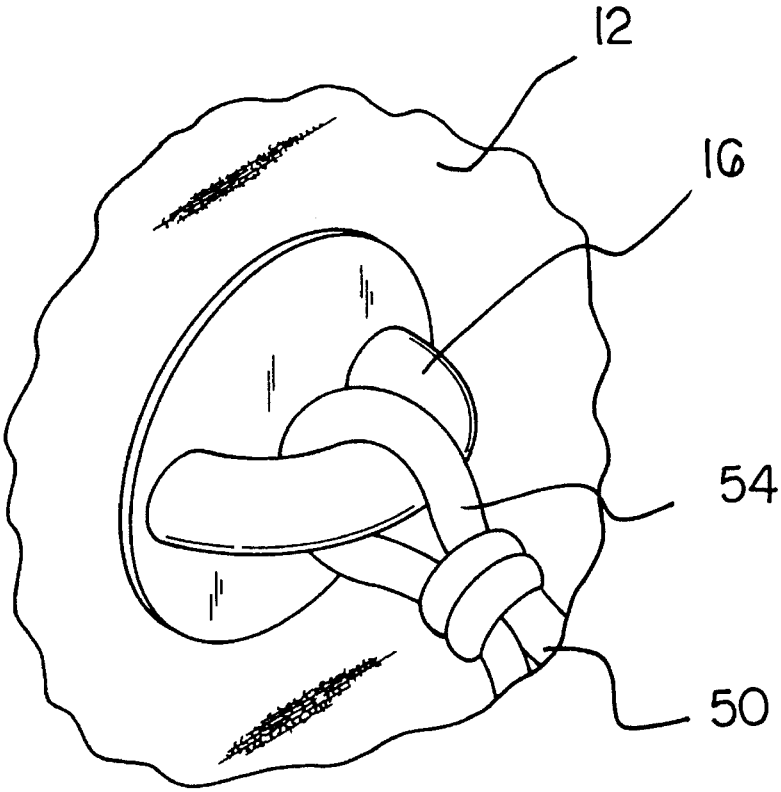
FIG. 8

FLOATING RECREATIONAL SEATING DEVICE

BACKGROUND OF THE INVENTION

1. Field of the Invention

The present invention relates to a floating recreational seating device and more particularly pertains to providing a device that floats and holds beverages with a floating recreational seating device.

2. Description of the Prior Art

The use of floating chairs is known in the prior art. More specifically, floating chairs heretofore devised and utilized for the purpose of supporting a person on water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,004,296 to Ziegenfuss, Jr. discloses a floating lounge chair.

U.S. Pat. No. Des. 290,108 to Wolfe discloses the ornamental design for a floatable chair.

U.S. Pat. No. 4,564,240 to Thieme discloses a lounger or reclining chair made from a floatable plastic body.

U.S. Pat. No. Des. 247,938 to Rankin discloses the ornamental design for a floatable lounge chair or similar article.

U.S. Pat. No. 3,984,888 to DeLano discloses an adjustable floating chair.

While these devices fulfill their respective, particular objective and requirements, the aforementioned patents do not describe a floating recreational seating device for providing a device that floats and holds beverages.

In this respect, the floating recreational seating device according to the present invention substantially departs from the conventional concepts and designs of the prior art, and in doing so provides an apparatus primarily developed for the purpose of providing a device that floats and holds beverages.

Therefore, it can be appreciated that there exists a continuing need for new and improved floating recreational seating device which can be used for providing a device that floats and holds beverages. In this regard, the present invention substantially fulfills this need.

SUMMARY OF THE INVENTION

In the view of the foregoing disadvantages inherent in the known types of floating chairs now present in the prior art, the present invention provides an improved floating recreational seating device. As such, the general purpose of the present invention, which will be described subsequently in greater detail, is to provide a new and improved floating recreational seating device and method which has all the advantages of the prior art and none of the disadvantages.

To attain this, the present invention essentially comprises an inflatable tube portion formed by four semi-circle portions. The inflatable tube portion has an interior portion, a top portion, a bottom portion, an inner portion, and an outer portion. Four securement rings are secured to the inner portion adjacent to each of the four semi-circle portions. Four sockets are secured within the top portion. An air intake valve extends inwardly within the interior portion from the outer portion. The air intake valve couples with a pipe that extends inwardly of the inflatable tube portion. The interior portion has a plurality styrofoam blocks disposed intermittently therein. Each of the styrofoam blocks has a pipe extending therethrough. The pipe allows air to flow through the interior portion. The top portion has a pocket formed therein. The outer portion has a securement clasp theresecured. The inflatable tube portion serves to fill with air to float in a body of water. Four seat portions are secured to the four semi-circle portions of the inflatable tube portion. The four seat portions extend downwardly of the bottom portion of the inflatable tube portion. The four seat portions are adapted for a user to sit in while the inflatable portion is within a body of water. Four drink holders are secured within the top portion of the inflatable tube portion adjacent to the four seat portions. The four drink holders are adapted to hold a beverage can or bottle therein. The device contains four umbrellas. Each of the four umbrellas has a shaft portion extending downwardly therefrom. The shaft portions of the four umbrellas are adapted for securement within the four sockets of the inflatable tube portion. The device contains an anchor having a securement string secured thereto. The securement string has an end portion securing to the securement clasp of the inflatable tube portion. The anchor is adapted to be received within the pocket of the inflatable tube portion when not in use. The device contains a square support portion having securement cords extending outwardly from four corners thereof. The securement cords have end portions secured to the four securement rings of the inflatable tube portion. The square support portion is adapted to hold an ice chest or cooler thereon when the inflatable tube portion is within a body of water.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved floating recreational seating device which has all the advantages of the prior art floating chairs and none of the disadvantages.

It is another object of the present invention to provide a new and improved floating recreational seating device which may be easily and efficiently manufactured and marketed.

It is a further object of the present invention to provide a new and improved floating recreational seating device which is of durable and reliable construction.

An even further object of the present invention is to provide a new and improved floating recreational seating device which is susceptible of a low cost of manufacture with regard to both materials and labor, and which accordingly is then susceptible of low prices of sale to the consuming public, thereby making such a floating recreational seating device economically available to the buying public.

Still yet another object of the present invention is to provide a new and improved floating recreational seating device which provides in the apparatuses and methods of the prior art some of the advantages thereof, while simultaneously overcoming some of the disadvantages normally associated therewith.

Even still another object of the present invention is to provide a new and improved floating recreational seating device for providing a device that floats and holds beverages.

Lastly, it is an object of the present invention to provide a new and improved floating recreational seating device comprised of an inflatable tube portion formed by four semi-circle portions. An air intake valve extends inwardly within the inflatable tube portion. The air intake valve couples with a pipe that extends inwardly of the inflatable tube portion. The inflatable tube portion has a plurality styrofoam blocks disposed intermittently therein. Each of the styrofoam blocks has a pipe extending therethrough. The pipe allows air to flow through the inflatable tube portion. The inflatable tube portion serves to fill with air to float in a body of water. Four seat portions are secured to the four semi-circle portions of the inflatable tube portion. The four seat portions extend downwardly of the inflatable tube portion. The four seat portions are adapted for a user to sit in while the inflatable portion is within a body of water. A square support portion secures to the four securement rings of the inflatable tube portion. The square support portion is adapted to hold an ice chest or cooler thereon when the inflatable tube portion is within a body of water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view as taken along line 3—3 of FIG. 2.

FIG. 4 is a cross-sectional view as taken along line 4—4 of FIG. 2.

FIG. 5 is a perspective view of the air intake valve of the present invention.

FIG. 6 is a side elevation view of the beverage holder of the present invention.

FIG. 7 is a side elevation view of the cooler holding chamber of the present invention.

FIG. 8 is a perspective view of the cooler tie down ring of the present invention.

The same reference numerals refer to the same parts through the various Figures.

DESCRIPTION OF THE PREFERRED EMBODIMENT

Figure 1:
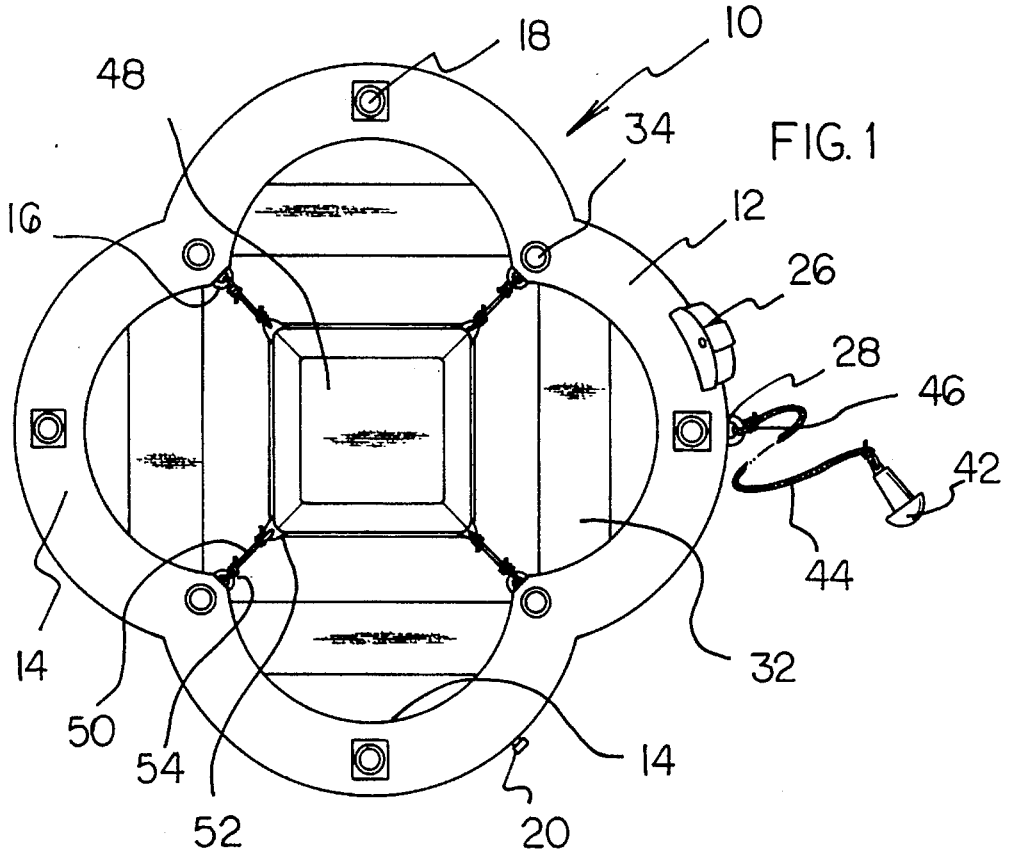
FIG. 1 is a plan view of the preferred embodiment of the floating recreational seating device constructed in accordance with the principles of the present invention.

With reference now to the drawings, and in particular, to FIG. 1 thereof, the preferred embodiment of the new and improved floating recreational seating device embodying the principles and concepts of the present invention and generally designated by the reference number 10 will be described.

Specifically, it will be noted in the various Figures that the device relates to a new and improved floating recreational seating device for providing a device that floats and holds beverages. In its broadest context, the device consists of an inflatable tube portion, four seat portions, four drink holders, four umbrellas, an anchor, and a square support portion.

The device 10 contains an inflatable tube portion 12 formed by four semi-circle portions 14. The inflatable tube portion 12 has an interior portion, a top portion, a bottom portion, an inner portion, and an outer portion. Four securement rings 16 are secured to the inner portion adjacent to each of the four semi-circle portions 14. Four sockets 18 are secured within the top portion. An air intake valve 20 extends inwardly within the interior portion from the outer portion. The air intake valve 20 couples with a pipe 22 that extends inwardly of the inflatable tube portion 12. As best illustrated by FIG. 5, the air intake valve 20 has a cap that is removably secured thereto. The air intake valve 20 is adapted to allow an air pump to fill the inflatable tube portion 12 with air. The interior portion has a plurality styrofoam blocks 24 disposed intermittently therein. As best illustrated by FIG. 3, each of the styrofoam blocks 24 has a pipe 22 extending therethrough. The styrofoam blocks are positioned within the interior portion within each of the four semi-circle portions 14 to prevent the inflatable tube portion 12 from sinking in case the inflatable tube portion 12 becomes deflated while in the water. The pipe 22 allows air to flow through the interior portion. The pipe allows air to be evenly distributed among the four semi-circle portions 14. The top portion has a pocket 26 formed therein. The outer portion has a securement clasp 28 theresecured. The inflatable tube portion 12 serves to fill with air to float in a body of water 30.

Figure 2:
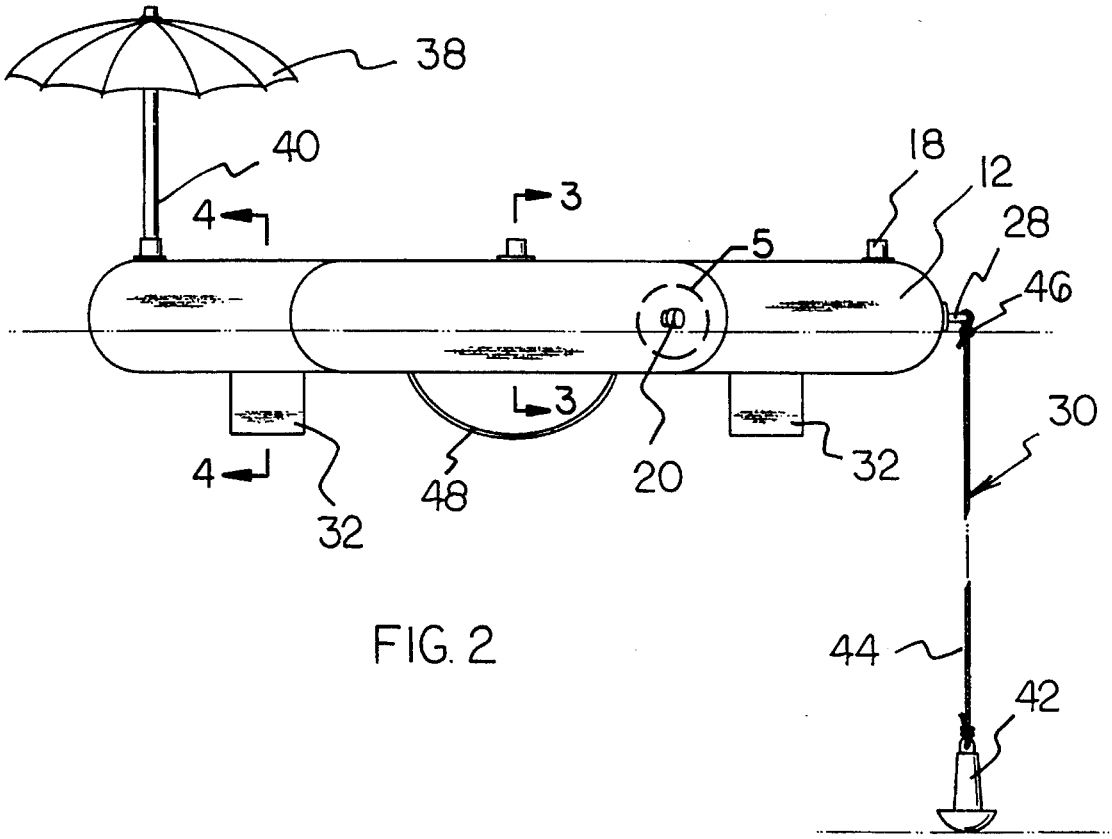
FIG. 2 is a side elevation view of the present invention.

Four seat portions 32 are secured to the four semi-circle portions 14 of the inflatable tube portion 12. The four seat portions 32 extend downwardly of the bottom portion of the inflatable tube portion 12. The four seat portions 32 are adapted for a user to sit in while the inflatable tube portion 12 is within a body of water 30. As best illustrated by FIG. 2, the seat portions 32 are positioned down within the body of water when the inflatable tube portion 12 floats above the water. The four seat portions 32 are rectangular in shape and are preferably stitched to the inflatable tube portion as illustrated best by FIG. 4. The seat portions 32 are sized to allow for one person to sit thereon.

Four drink holders 34 are secured within the top portion of the inflatable tube portion 12 adjacent to the four seat portions 32. The four drink holders 34 are adapted to hold a beverage can 36 or bottle therein. As best illustrated in FIG. 6, the four drink holders 34 extend downwardly within the inflatable tube portion. Each of the four drink holders 34 is sized to hold one individual can or bottle. The device 10 can also be equipped with more or less than four drink holders.

The device 10 contains four umbrellas 38. Each of the four umbrellas 38 has a shaft portion 40 extending downwardly therefrom. The shaft portions 40 of the four umbrellas 38 are adapted for securement within the four sockets 18 of the inflatable tube portion 12. The four umbrellas 38 are removably secured within the four sockets 18. The umbrellas 38 are positioned over each of the four seat portions 32 to provide shade from the sun for the user's. The umbrellas 38 could be made as an optional accompaniment for the device 10 or included with the device 10.

The device 10 contains an anchor 42 having a securement string 44 secured thereto. The securement string 44 has an end portion 46 securing to the securement clasp 28 of the inflatable tube portion 12. The anchor 42 is adapted to be received within the pocket 26 of the inflatable tube portion 12 when not in use. The anchor 42 allows for the user's to prevent the inflatable tube portion 12 from floating by submerging the anchor 42 down to the bottom of a body of water as seen in FIG. 2.

The device 10 contains a square support portion 48 having securement cords 50 extending outwardly from four corners 52 thereof. As best illustrated in FIG. 8, the securement cords 50 have end portions 54 secured to the four securement rings 16 of the inflatable tube portion 12. The square support portion 48 is adapted to hold an ice chest or cooler 56 thereon when the inflatable tube portion 12 is within a body of water 30. As best illustrated in FIG. 1, the square support portion 48 is positioned in the middle of the inflatable tube portion 12. FIG. 7 illustrates the cooler supported by the square support portion 48 as the cooler becomes slightly submerged in the body of water thereby providing a cooling means for the products therein.

The present invention is a recreational water seating for a group of people that floats and holds beverages.

The inflatable tube portion 12 is approximately nine feet in diameter and made of a durable rubber tube of about twelve inches in diameter, with four styrofoam blocks 24 inside. The tube 12 is shaped as four half-circles 14 joined in a ring with recessed, submerged canvas or rubber seat portions 32 attached to each half-circle 14. Each seat portion 32 has its own drink holder 34 and a socket 18 to insert an umbrella 38 or canopy. A pipe 22 with an air intake valve 20 at one end travels throughout the inside of the tube 12 and through the styrofoam 24 on all sides for one-step inflating. In the center is an ice chest that floats on its own canvas or rubber seat.

The product is first inflated through the air intake valve 20. When fully inflated, up to four people may sit in the seats 32 under optional umbrellas 38. Beverages can easily be reached from the central ice chest. Dropping the anchor 42 keeps it from floating away. In case of accidental deflation, the styrofoam 24 within the tube 12 keeps it afloat.

Common floatation products only allow individual use and people struggle to stay near each other. Use of this tube 12 keeps a group of people together to socialize. Although it provides a great way to get sun, the canopy shields those who desire shade. Anyone who doesn't want to get too wet or be in a boat can enjoy the convenience of this product. It is ideal for people with swimming pools or those who live near or frequently travel to water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A floating recreational seating device for providing a device that floats and holds beverages comprising, in combination:

an inflatable tube portion formed by four semi-circle portions, an air intake valve extends inwardly within the inflatable tube portion, the air intake valve coupling with a pipe that extends inwardly of the inflatable tube portion, the inflatable tube portion having a plurality styrofoam blocks disposed intermittently therein, each of the styrofoam blocks having a pipe extending therethrough, the pipe allowing air to flow through the inflatable tube portion, the inflatable tube portion serving to fill with air to float in a body of water, the inflatable tube portion having four securement rings attached thereto;

four seat portions secured to the four semi-circle portions of the inflatable tube portion, the four seat portions extending downwardly of the inflatable tube portion, the four seat portions adapted for a user to sit in while the inflatable portion is within a body of water;

a square support portion secured to the four securement rings of the inflatable tube portion, the square support portion adapted to hold an ice chest or cooler thereon when the inflatable tube portion is within a body of water.

2. The device as described in claim 1 and further including the inflatable tube portion having four sockets within a top portion thereof.

3. The device as described in claim 2 and further including four drink holders secured within the top portion of the inflatable tube portion adjacent to the four seat portions, the four drink holders adapted to hold a beverage can or bottle therein.

4. The device as described in claim 3 and further including the top portion of the inflatable tube portion having a pocket formed therein.

5. The device as described in claim 4 and further including an outer portion of the inflatable tube portion having a securement clasp theresecured.

6. The device as described in claim 5 and further including an anchor having a securement string secured thereto, the securement string having an end portion attached to the securement clasp of the inflatable tube portion, the anchor adapted to be received within the pocket of the inflatable tube portion when not in use.

7. A floating recreational seating device for providing a device that floats and holds beverages comprising, in combination:

an inflatable tube portion formed by four semi-circle portions, the inflatable tube portion having an interior portion, a top portion, a bottom portion, an inner portion, and an outer portion, four securement rings secured to the inner portion adjacent to each of the four semi-circle portions, four sockets secured within the top portion, an air intake valve extends inwardly within the interior portion from the outer portion, the air intake valve coupling with a pipe that extends inwardly of the inflatable tube portion, the interior portion having a plurality styrofoam blocks disposed intermittently therein, each of the styrofoam blocks having a pipe extending therethrough, the pipe allowing air to flow through the interior portion, the top portion having a pocket formed therein, the outer portion having a securement clasp theresecured, the inflatable tube portion when filled with air will float in a body of water;

four seat portions secured to the four semi-circle portions of the inflatable tube portion, the four seat portions extending downwardly of the bottom portion of the inflatable tube portion, the four seat portions adapted for a user to sit in while the inflatable portion is within a body of water;

four drink holders secured within the top portion of the inflatable tube portion adjacent to the four seat portions, the four drink holders adapted to hold a beverage can or bottle therein;

four umbrellas, each of the four umbrellas having a shaft portion extending downwardly therefrom, the shaft portions of the four umbrellas adapted for securement within the four sockets of the inflatable tube portion;

an anchor having a securement string secured thereto, the securement string having an end portion securing to the securement clasp of the inflatable tube portion, the anchor adapted to be received within the pocket of the inflatable tube portion when not in use;

a square support portion having securement cords extending outwardly from four corners thereof, the securement cords having end portions securing to the four securement rings of the inflatable tube portion, the square support portion adapted to hold an ice chest or cooler thereon when the inflatable tube portion is within a body of water.

* * * * *